10/15/85 OR 4,547,698

United States Patent [19]

Gioia et al.

[11] Patent Number: 4,547,698

[45] Date of Patent: Oct. 15, 1985

[54] MAGNETIC DEFLECTION FIELD ENHANCER MEANS FOR TELEVISION CRT ELECTRON GUNS

[75] Inventors: Norman F. Gioia; Fred H. Seher, both of Lombard, Ill.

[73] Assignee: Zenith Electronics Corporation, Glenview, Ill.

[21] Appl. No.: 191,581

[22] Filed: Sep. 29, 1980

[51] Int. Cl.[4] ..... H01J 29/50

[52] U.S. Cl. ..... 313/414; 313/412

[58] Field of Search ..... 313/412, 414

[56] References Cited

U.S. PATENT DOCUMENTS

| | | | |
|---|---|---|---|
| Re. 29,895 | 1/1979 | Murata et al. | 313/411 |
| 3,548,249 | 12/1970 | Yoshida et al. | 313/428 |
| 3,860,850 | 1/1975 | Takenaka et al. | 313/428 |
| 4,196,370 | 4/1980 | Hughes | 313/413 |
| 4,225,804 | 9/1980 | Bekaert et al. | 313/412 |

*Primary Examiner*—David K. Moore

*Attorney, Agent, or Firm*—Ralph E. Clarke, Jr.

[57] ABSTRACT

An in-line electron gun in a color TV cathode ray tube generates three coplanar electron beams. The raster pattern projected by the center beam is diminished in vertical height so as to be non-coextensive with the two off-axis beams. The gun is characterized by having two pairs of inwardly converging but non-intersecting magnetic field enhancer means, one of each pair being located at a point of beam egress and embracing in symmetrical relationship one of the off-axis beams. Each member of each of the pairs comprises an L-shaped bracket with the brackets defining an opening therebetween, with one leg of each bracket providing for attachment to the electrode. The brackets, the predetermined angle and distance, and their separation and length are such that the enhancer means is effective to divert the flux of the vertical deflection field through the openings between the enhancer means. As a result, the vertical height of the raster pattern of the center beam is enhanced into coextensiveness with the raster patterns of the off-axis beams.

1 Claim, 4 Drawing Figures

MAGNETIC DEFLECTION FIELD ENHANCER MEANS FOR TELEVISION CRT ELECTRON GUNS

BACKGROUND OF THE INVENTION AND PRIOR ART DISCLOSURES

This invention relates to television cathode ray picture tubes and the electron guns used therein, and is particularly concerned with improving the performance of such guns.

An in-line electron gun generates three coplanar electron beams consisting of a center beam and two adjacent off-axis beams. The center beam is normally utilized to excite the green phosphor targets on the viewing screen of the color cathode ray tube, and the two off-axis beams are normally used to excite the red and blue phosphor targets. The three beams are caused to scan the viewing screen in unison, projecting a substantially rectangular raster pattern having an aspect ratio of, normally, 3:4. The beams are caused to scan by the influence of the fields produced by a deflection yoke which encircles the neck of the tube. The center beam, which lies on the tube axis, is subject to symmetrical yoke fields, while the two adjacent beams are subject to asymmetrical fields because of their off-axis location. As a result, the raster pattern projected by the center beam may differ in size from the superimposed raster patterns projected by the off-axis beams. The resulting aberration is known as "coma distortion."

Typical means to correct coma distortion are disclosed in U.S. Pat. No. 4,196,370 to Hughes and in UK Patent Application No. GB 2 020 480A to RCA. In one embodiment of the '370 patent, thin, washer-like magnetic shield members completely surround the outer beams. In another embodiment, shunts surrounding the outer beams are offset eccentrically toward the center beam relative to the outer beams. In the '480 A application disclosure, the raster correction means comprises, in one embodiment, thin, washer-like rings surrounding the outer beams, and two "rail-shaped" elements perpendicularly oriented to the plane of the three beams, and located between the beams.

A problem arises in the use of such washer-like elements in that the range of beneficial effects is limited. For example, increasing the thickness of the material has a diminishing effect. If the elements are made smaller to weaken the effect, the elements become so small as to be difficult to handle and install during manufacture.

Takenaka et al in U.S. Pat. No. 3,860,850 is directed to a set of shunts and enhancers located in the cathode ray tube between the output end of the electron gun and the deflection yoke. A pair of horseshoe-shaped shunting elements having high magnetic permeability surround the outer beams of the three-beam in-line gun and have their open ends vis-a-vis. The effect of the shunting is to shield the outer beam from a portion of the horizontal magnetic field such that the outer beam rasters are contracted relative to the raster traced by the center beam. In addition, two enhancers each having a V-shape are disposed above and below the plane of the electron beam; these enhancers act to concentrate the horizontal deflection field in the region of the center beam so as to expand the horizontal dimension of the raster formed with the center beam. The V-shaped enhancers also act to dilute the vertical deflection field in the region of the center beam so as to contract the vertical dimension of the center beam raster relative to the outer beam rasters.

Murata et al in U.S. Pat. No. Re. 28,895 discloses a cathode ray tube with an in-line gun wherein an electron beam control device in the form of a magnetically soft structure partially surrounds the outer beams to reduce the size of the rasters produced by the outer beams so as to bring them into coincidence with the center beam raster. Two devices in the form of horse shoes vis-a-vis surround the outer beams in a manner very similar to that shown by Takenaka et al. Also as with Takenaka et al, the two devices act as shunts to shield the outer beams from a portion of the horizontal magnetic field, and hence contract the rasters projected by its outer two beams.

In U.S. Pat. No. 3,548,249 to Yoshida et al, there are disclosed horse-shoe-shaped elements located adjacent the center beam but facing outwardly so as to partially enclose the outer beams. As with the similarily shaped elements of Takenaka et al and Murata et al, the elements act as shunts to reduce the size of the rasters of the outer beams into coincidence with the center beam rasters.

OBJECTS OF THE INVENTION

It is a general object of this invention to provide means for improving the peformance of television cathode ray picture tubes having in-line electron guns.

It is a less general object to provide means for ensuring that a coextensive raster pattern is projected by the three-beam in-line gun.

It is a more specific object of the invention to provide raster-correction components that can be handled and installed quickly and inexpensively during manufacture.

It is a specific object of this invention to provide raster-correction components whose configurations and installation parameters can be easily controlled to alter the influence of yoke fields on raster registration.

BRIEF DESCRIPTION OF THE DRAWINGS

The appended claims set forth those novel features believed characteristic of the invention. However, the invention itself, as well as further objects and advantages thereof, will best be understood by reference to the following detailed description of a preferred embodiment taken in conjunction with the accompanying drawings, in which:

DESCRIPTION OF THE PREFERRED EMBODIMENT

Figure 1A:
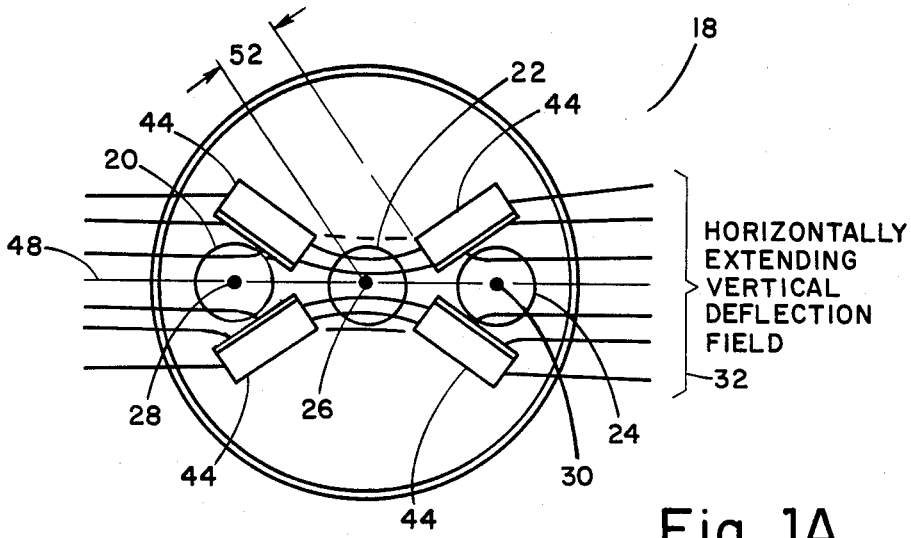
FIG. 1A is a plan view of a shield cup for a three-beam in-line electron gun having enhancer means according to the invention.
Figure 1B:
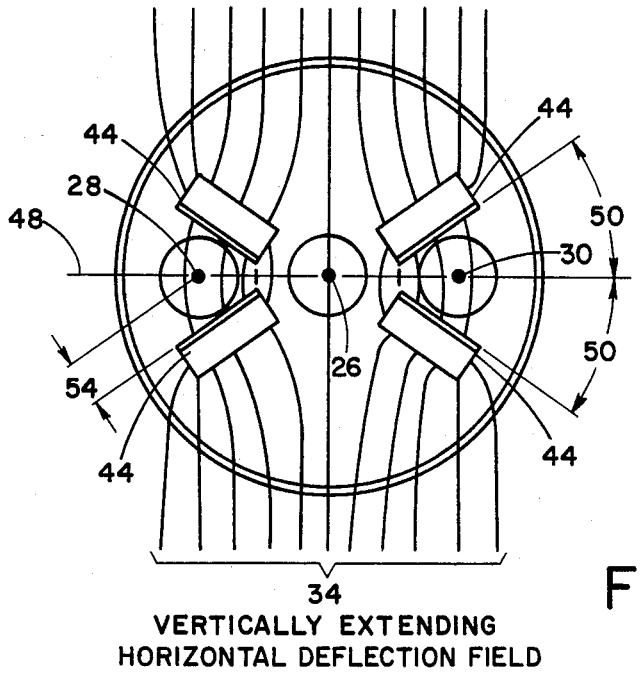
FIG. 1B is an identical view of the same shield cup provided for clarity in depicting additional aspects of the invention.

An in-line electron gun for use in a color television cathode ray picture tube generates three side-by-side coplanar electron beams. The three beams emerge from the gun to pass through respective apertures in a final electrode which may be termed a convergence cup, or shield cup. A plan view of a typical shield cup 18 is shown by FIGS. 1A and 1B. Only one shield cup is actually represented; two views of the same cup are shown by the figures to clearly depict the effect of two magnetic fields extending in different directions.

Three electron beams are shown emerging from respective apertures 20, 22 and 24 into a beam deflection region which may be considered as extending outwardly from the page toward the viewer. The diameter of the apertures may be, for example, 0.160 inch. The beams consist of a center beam 26 which is coincident with the axis of the cathode ray tube, and which emerges into the deflection region from center aperture 22. The two adjacent off-axis beams 28 and 30 emerge into the deflection region from respective apertures 20 and 24. The beam deflection region has a horizontally extending magnetic field flux path 32, indicated in FIG. 1A by the bracket: this horizontally extending field provides for deflecting the beams 26, 28 and 30 in unison vertically, as is well known in the art. Similarily, and as shown by FIG. 1B, the beam deflection region also has a vertically extending magnetic field flux path 34, indicated by the bracket; this vertically extending flux path provides for deflecting beams 6, 28 and 30 in unison horizontally.

Figure 2:
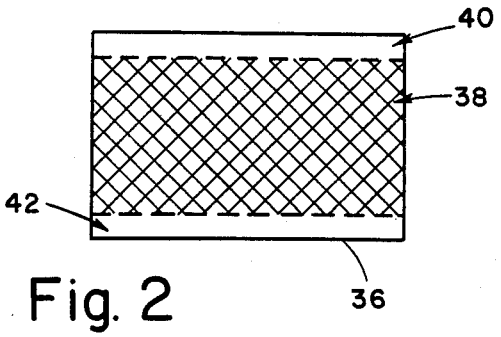
FIG. 2 is a diagram depicting non-coextensive raster patterns projected by a three-beam in-line electron gun.

The center beam 26, being coincident with the tube axis, is subject to relatively symmetrical yoke fields. Beams 28 and 30, however, are subject to asymmetrical yoke fields because of their off-axis location. The raster pattern projected on the cathode ray tube screen by the center beam 26 is diminished in vertical height as a result of its on-axis location so as to be non-coextensive with the superimposed raster patterns projected by the off-axis beams 28 and 30. This condition is depicted diagrammatically in FIG. 2 wherein the outline of the superimposed raster pattern 36 projected by the two off-axis beams 28 and 30 is compared to what may be termed a "small green" raster pattern 38 projected by the center beam 26. The undesired effect is a magenta hue in areas 40 and 42 which are deprived of green phosphor target excitation otherwise provided by center beam 26. As has been noted, this condition of non-coextensiveness in raster patterns is termed coma distortion.

The electron gun according to the invention is characterized by having a pair of inwardly converging but non-intersecting magnetic field enhancer means located at the point of beam egress from the gun and embracing each off-axis beam in symmetrical relationship. Each member of the pair of enhancer means is shown as comprising an L-shaped bracket means 44, one leg of which is indicated as providing for the attachment to shield cup 18.

Figure 3:
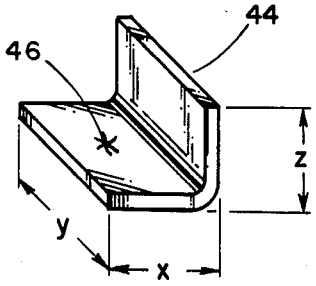
FIG. 3 is a view in perspective of a preferred embodiment of magnetic field enhancer means according to the invention.

The configuration and relative dimensions of each of the L-brackets according to the invention may be, by way of example, as depicted in FIG. 3. The x and y dimensions may be 0.085 inch, for example, and the z dimension 0.2 inch. Material thickness may be about 0.010 inch. The material is preferably of a medium to high magnetic permeability such as Type 4750 alloy, which consists of approximately equal parts of iron and nickel. The L-configuration offers the benefit of easy handling and fixturing during manufacture. Atachment to the associated electrode may be by means of a single spot weld through one leg as indicated by the weld symbol 46. It is to be noted that the enhancer means according to the invention is not limited to the L-bracket configuration described and shown, nor to the dimensions set forth. For example, the enhancer means may be rod-shaped, rail-shaped, or rectangular, and the attachment to the associated electrode may be by means of rivets or other well-known mechanical fastening means. The length of the enhancer means 44 (the aforedescribed "z" dimension) may be (a) as little as 0.1 inch to (b), as long as the distance between aperture 22 to the periphery of shield cup 18.

The enhancer means according to the invention, shown as comprising L-brackets, are oriented at a predetermined convergence angle with respect to the plane 48 of the path of the three beams 26, 28 and 30; this plane is indicated in FIGS. 1A and 1B by the line intersecting the three beams. The enhancer means convergence angle 50 is indicated in FIG. 1B; the angle may be for example about 35° and is preferably in the range of 5° to 60°. The opposite pair of brackets 44 are similarily oriented at the selected convergence angle 50.

The enhancer means 44 are located at a predetermined distance from the tube axis. An exemplary distance is indicated in FIG. 1A by distance 52 as shown as being the distance between center beam 26 and the end of bracket 44 nearest center beam 26. This distance may be, by way of example, about 0.135 inch. However, the enhancer means according to the invention may be located (a), as close as tangential to aperture 22 (i.e., 0.160 inch from center beam 26) to (b), as far as 0.30 inch from center beam 26. The farthest distance obtainable is dependent, of course, on the length "z" of the enhancer means 44. Dimension 52 is particularly critical in that it controls the amount of effect for a given enhancer means convergence angle 50.

Another dimension of interest, but not as critical as distance 52, is the distance between the off-axis beams 28 and 30 and the embracing magnetic field enhancers 44. This dimension 54 is shown by FIG. 1B; the distance may be about 0.085 inch, for example. However, the enhancer means according to the invention may be located (a), as close as tangential to the associated aperture to (b), as far as 0.150 inch from the associated beam.

The enhancer means according to the invention, the predetermined convergence angle and distance, and the separation and length of the enhancer means are such that the enhancer means is effective to divert the flux of the vertical deflection field 32 onto center beam 26. As a result, the height of the raster pattern 38 projected by center beam 26 is enhanced into coextensiveness with the raster patterns 36 and projected by the off-axis beams 28 and 30. The benefit of the enhancer means according to the invention is observable by reference to FIG. 1A wherein the enhancer means 44 are shown as being effective in diverting the flux of the vertical deflection field 32 onto center beam 26. The result is the enhancement of the height of the raster pattern projected by center beam 26, as has been noted.

The magnetic field enhancer means as configured and arranged in the deflection zone according to the invention (and shown as being L-brackets) have only minimal effect on the vertical field which provides for horizontal deflection of the beams. This minimal effect on the vertically extending horizontal deflection field 34 is observable in FIG. 1B. The flux of the horizontal deflection field will be seen to digress from the center beam 26 and thus have relatively little influence on the center beam raster. It is also to be noted that the flux of the horizontal deflection field will exert relatively little raster-altering influence on the outer beams 28 and 30. This small effect of the horizontal deflection field is beneficial in that it provides for "fine tuning" in raster width matching at the 3 o'clock and 9 o'clock positions;

that is, large mechanical changes produce very small changes in raster width, a desirable characteristic when adjusting for horizontal deflection. "Fine tuning" is accomplished by adjusting the angle 50 of the brackets 44. The greater the angle (within the aforedescribed range), the greater the effect in adjusting raster width at the 3 o'clock and 9 o'clock positions.

The enhancer means according to the invention provides the benefit of rendering the electron gun more tolerant with respect to variations in yoke characteristics and placement. As a result, yokes having characteristics otherwise resulting in unacceptable coma distortion can be utilized. The enhance means acording to the invention provides for vertical enhancement of the center beam raster while substantially immunizing the deflection field against the effects of yoke influences which can cause undesired raster enlargement in a horizontal direction of the raster projected by the off-axis beams. Thus the yoke yield in cathode ray tube manufacture is improved as yokes that otherwise would have to be rejected can be utilized. Experience has shown that yoke yields can be enhanced by as much as 10 percent.

While a particular embodiment of the invention has been shown and described, it will be obvious to those skilled in the art that changes and modifications may be made without the departing from the invention in its broader aspects, and therefore, the aim in the appended claims is to cover all such changes and modifications falling within the true spirit and scope of the invention.

We claim:

1. An in-line electron gun for use in a color television cathode ray tube having a viewing screen, said gun generating three coplanar electron beams consisting of a center beam coincident with the tube axis, and two adjacent off-axis beams, said beams passing through, respectively, a center aperture and two off-axis apertures in a shield cup electrode of said gun to enter a beam deflection region having horizontally and vertically extending magnetic flux paths providing for respective vertical and horizontal beam deflection fields for deflecting said beams in unison to project a raster pattern on said screen, the raster pattern projected by said center beam being diminished in vertical height so as to be non-coextensive with the pattern projected by the two off-axis beams, said gun being characterized by having two pairs of inwardly converging but non-intersecting magnetic field enhancer means, one of each pair being located at a point of beam egress from the gun and embracing in symmetrical relationship one of said off-axis beams, each member of each of said pairs of enhancer means comprising an L-shaped bracket with said brackets defining an opening therebetween, one leg of each bracket providing for attachment to said electrode, with each bracket being oriented at a predetermined convergence angle in the range of 5° to 60° with respect to the plane of the three beam paths, and located at a predetermined distance in the range of (a) tangential to said center aperture to (b), as far as 0.30 inch from said center beam, said brackets, said predetermined angle and distance, and the separation and length of said brackets being such that the enhancer means is effective to divert the flux of said vertical deflection field through the openings between the enhancer means onto said center beam to enhance the vertical height of the raster pattern of said center beam into coextensiveness with the raster patterns projected by said off-axis beams.

* * * * *